US005238058A

United States Patent [19]

Bodrey et al.

[11] Patent Number: 5,238,058

[45] Date of Patent: Aug. 24, 1993

[54] SPIRAL FLIGHTED DOUBLE WALLED HEAT EXCHANGER

[76] Inventors: Douglas M. Bodrey, Rte. 4, Lakeview Dr., Box 440-B, Cordele, Ga. 30521; Carl C. Hiller, 7404 Sedgefield Dr., San Ramon, Calif. 94583; Andrew L. Blackshaw, 4747 Shadow Bend, Dunwoody, Ga. 30338; Glen P. Robinson, Jr., 1050 Mt. Paran Rd., NW., Atlanta, Ga. 30327

[21] Appl. No.: 672,100

[22] Filed: Mar. 18, 1991

[51] Int. Cl.[5] ..... F28D 7/02

[52] U.S. Cl. ..... 165/164; 165/169; 29/890.037

[58] Field of Search ..... 165/164, 169; 29/890.037

[56] References Cited

U.S. PATENT DOCUMENTS

| | | | |
|---|---|---|---|
| 3,739,842 | 6/1973 | Whalen | 165/164 |
| 4,196,772 | 4/1980 | Adamski et al. | 165/169 |
| 4,316,502 | 2/1982 | Sanborn et al. | 165/140 |
| 4,379,390 | 4/1983 | Bottum | 165/169 |
| 4,434,539 | 3/1984 | Sanborn et al. | 29/890.037 |
| 4,739,630 | 4/1988 | Tandeski et al. | 165/169 |
| 4,763,725 | 8/1988 | Longsworth et al. | 165/164 |

*Primary Examiner*—John Rivell
*Assistant Examiner*—L. R. Leo
*Attorney, Agent, or Firm*—B. J. Powell

[57] ABSTRACT

A heat transfer coil and method of manufacture where a second piece of tubing is wound around a first piece of tubing while the first piece is straight, where the first piece of tubing is then formed to define the overall coil shape, and then the first and second pieces of tubing internally sized by internal pressurization to also force the two pieces of tubing into intimate contact with each other.

10 Claims, 4 Drawing Sheets

FIG 5
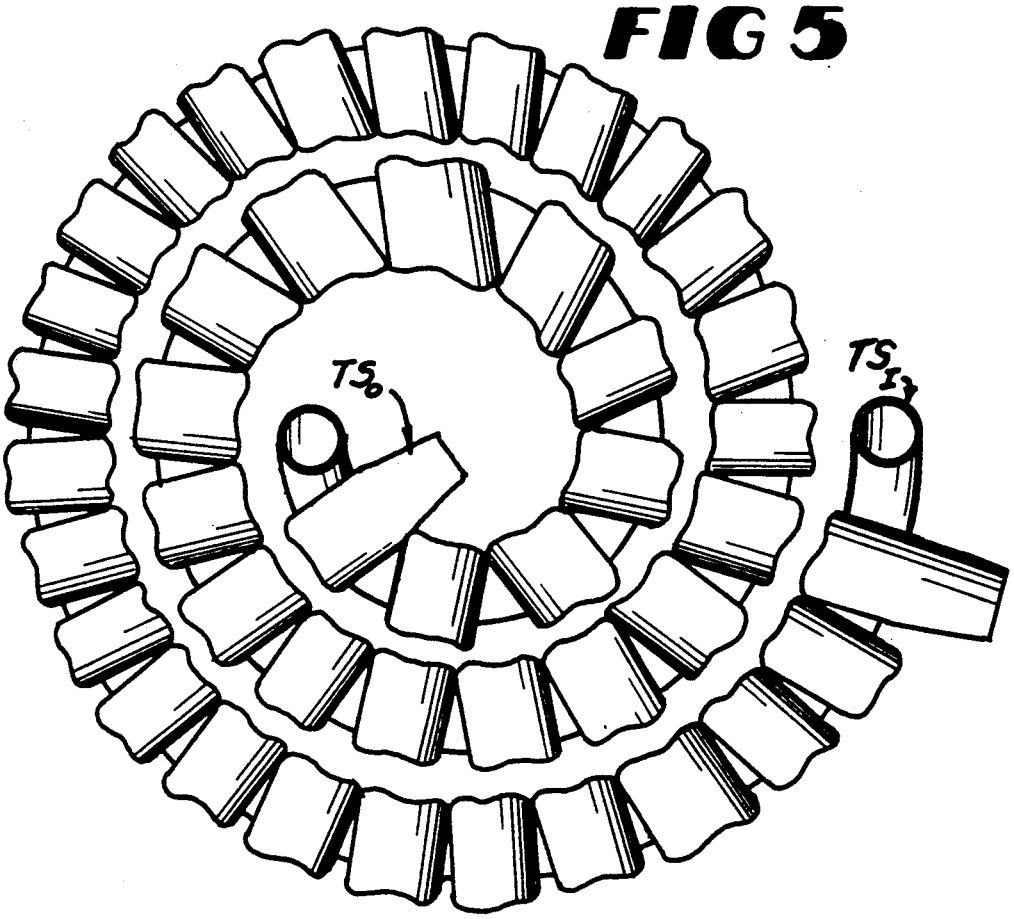
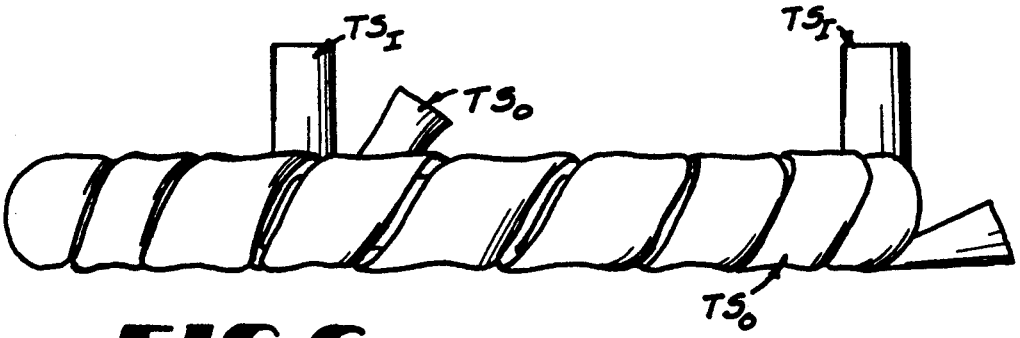
FIG 6

SPIRAL FLIGHTED DOUBLE WALLED HEAT EXCHANGER

BACKGROUND OF THE INVENTION

This invention relates generally to heat exchangers and more particularly to double wall helically flighted heat exchangers.

Prior art heat exchangers are described in U.S. Pat. Nos. 4,316,502 and 4,434,539. These heat exchangers have been in widespread use in heat pump water heaters, desuperheaters, and water source heat pumps since 1980 and have performed very satisfactorily. They are highly efficient, relatively easy to manufacture and offer the unique feature of being classified as a double wall heat exchanger. The double wall feature is required by many building codes to isolate the refrigerant circuit from the water circuit to prevent the high pressure refrigerant and oil from entering the potable water line in the event of a rupture in a single wall heat exchanger. A break in either the refrigerant line or the water line allows the refrigerant or water to escape to the atmosphere rather than enter the other coil.

These prior art heat exchangers are typically made by winding at least two metal tubes (usually copper) that are to serve as the refrigerant and water tubes of the heat exchanger around a separate steel mandrel with steel end plates to which the wound tubes are clamped to prevent unwinding. During the winding process, the tubes collapse and then are expanded by internally pressurizing them to open the passageways back to the desired cross-sectional size. The size and shape of the tube coil is determined by the size and shape of the steel mandrel. This has limited the size and shape of the resulting heat exchanger. Moreover, all of the tubes in the coil had to have the same coiled configuration so that good heat transfer contact be maintained between the tubes.

SUMMARY OF THE INVENTION

These and other problems associated with the prior art are overcome by the present invention by eliminating the need for a mandrel and end plates during manufacture thereby reducing the manufacturing cost and weight and also permitting the coils in the heat exchanger to have a wide variety of sizes and shapes. Further, because one of the tubes forming the heat exchanger is wrapped around the other tube, the wrapped tube can then be formed into one of many different shaped coils. The refrigerant tube is wound in spiral flights around a straight length of tubing which serves as the water circuit. This straight section may then be formed into a helical, spiral, or serpentine shape in order to make it more compact. Next the refrigerant tube is internally pressurized to finally size it, usually after the tubes have been annealed to a dead soft condition.

The heat transfer coil assembly includes a first elongate piece of heat conductive tubing with a second piece of heat conductive tubing wound therearound in conforming intimate physical contact with the peripheral surface on said first piece of heat tubing, and with the cross-sectional area of the passage through second piece of tubing adjusted by internally pressurizing the second piece of tubing to non-elastically deform the second piece of tubing to size the passage. The first piece of tubing is formed into the desired overall coil shape while the second piece of tubing remains wound around the first piece of tubing.

The method of manufacture of the coil assembly includes the steps of:

winding a second piece of tubing helically around a first piece of tubing to form a coil so that the second piece of tubing lies against the peripheral surface of the first piece of tubing and is deformed into a non-circular shape;

non-elastically forming the first of piece of tubing into an overall coil configuration independently of the configuration of the second piece of tubing; and internally pressurizing the second piece of tubing to non-elastically deform the second piece of tubing to change the cross-sectional area of the passage through the second piece of tubing to a desired final size while maintaining intimate physical contact between the pieces of tubing. The method may also include annealing the tubing before the pressurizing step. Pressurizing the first piece of tubing while the second piece of tubing is pressurized may also be necessary to prevent collapse, depending on its wall thickness.

These and other features and advantages of the invention will become more clearly understood upon consideration of the following detailed description and accompanying drawings wherein like characters of reference designate corresponding parts throughout the several views and in which:

BRIEF DESCRIPTION OF THE DRAWINGS

FIGS. 3–7 illustrate the intermediate stage in the manufacture of the heat transfer coil assembly utilizing the invention.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
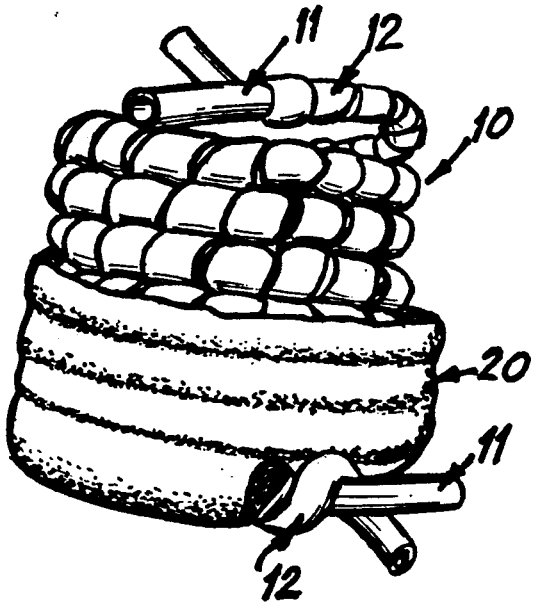
FIG. 1 is a perspective view illustrating a heat transfer coil assembly made in accordance with the invention.

Referring to FIG. 1, the completed heat transfer coil assembly 10 includes an inner coil 11 around which is formed an outer coil 12. The coil assembly 10 is typically used to heat water with the inner coil 11 carrying the water while the outer coil 12 carries the refrigerant. It will be appreciated that the outer coil 12 may be made up of a single tube or a plurality of tubes to minimize the pressure drop through the refrigerant circuit. For example, two parallel tubes in the refrigerant outer coil 12 would have approximately ⅛ the pressure drop of a single tube since the pressure drop is proportional to the square of the velocity, each circuit carries only ½ of the total refrigerant flow and each path is half as long as a single circuit. The inner coil 11 is formed into the general configuration of the overall coil assembly and also serves as a support for the outer coil 12 as it is being formed as will become more apparent.

Both the inner and outer coils 11 and 12 are made out of the formable material such as copper with the tube wall thickness of the outer coil typically being thinner than that of the inner coil so that the cross-sectional configuration of the inner coil will be only marginally changed as a result of the formation of the outer coil 12 thereon. As will be seen in FIG. 8, the cross-section of the tube wall 14 of the inner coil 11 remains substantially circular while tube wall 15 has a straight inboard section 16 along the inside of the coil 12 integral with a curved outboard section 18 along the outside of the coil 12. The straight inboard section 15 is in intimate contact with the outside surface with the inner coil. The selection of the length and cross-sectional sizes of the inner and outer coils 11 and 12 are selected using known design methods. Typically, the coil assembly 10 is provided with an insulating covering 20 as seen in FIG. 1.

Figure 2:
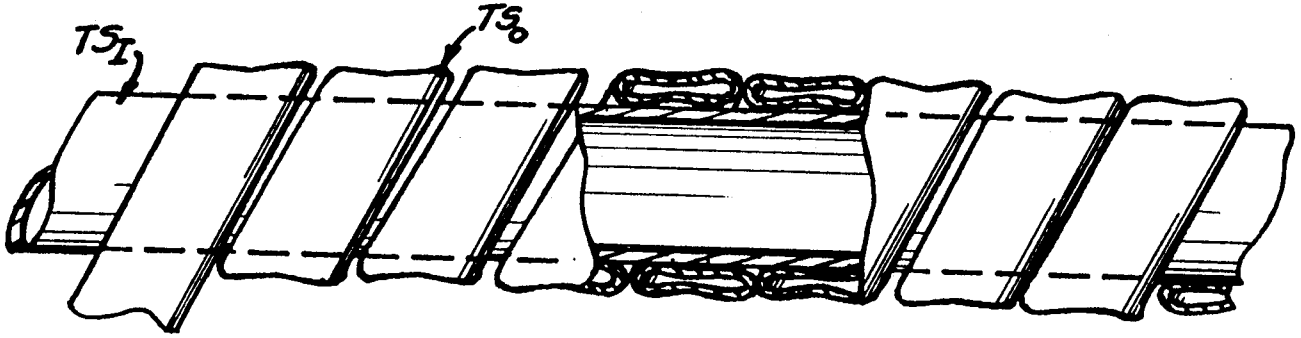
FIG. 2 is a side view of a short section of the heat transfer coil assembly shown partly in cross-section and showing the initial stage in the manufacture thereof using the invention.

In the manufacture of the heat exchanger assembly 10, the initial step is illustrated in FIG. 2 with the piece of tubing $TS_I$ to be formed into the inner coil being generally straight while the piece or pieces of tubing $TS_O$ to be formed into the outside coil is helically wound around the inside tube in helical flights so that the outside tube collapses as an incident to being wound around the inside tube. While it is not required, the inside tube $TS_I$ is typically collapsed very little as the outside tube $TS_O$ is wound therearound. The collapse of the inside tube $TS_I$ can be limited to a very small amount by internally supporting the inside tube $TS_I$ during the winding step or by selecting a sufficient wall thickness and hardness combination for the inside tube $TS_I$ to prevent its collapse without separate internal support. Where the inside tube $TS_I$ is to be internally supported, internal pressurization or a support mandrel is typically used. Where the inside tube $TS_I$ is to be self supporting, a combination of wall thickness and hardness is selected which is strong enough to prevent collapse when the particular outside tube $TS_O$ is being wound around the inside tube. Typically, the thicker the wall thickness, the less hard the temper can be without the inside tube collapsing. While not meant to be limiting, thicknesses range over about 0.016–0.032 inch and a hardness range from dead soft to about half hard are typically used for the inside tube $TS_I$. After the winding step, the outside tube $TS_O$ is usually in contact with the outside peripheral surface of the inside tube $TS_I$ as seen in FIG. 2.

Figure 7:
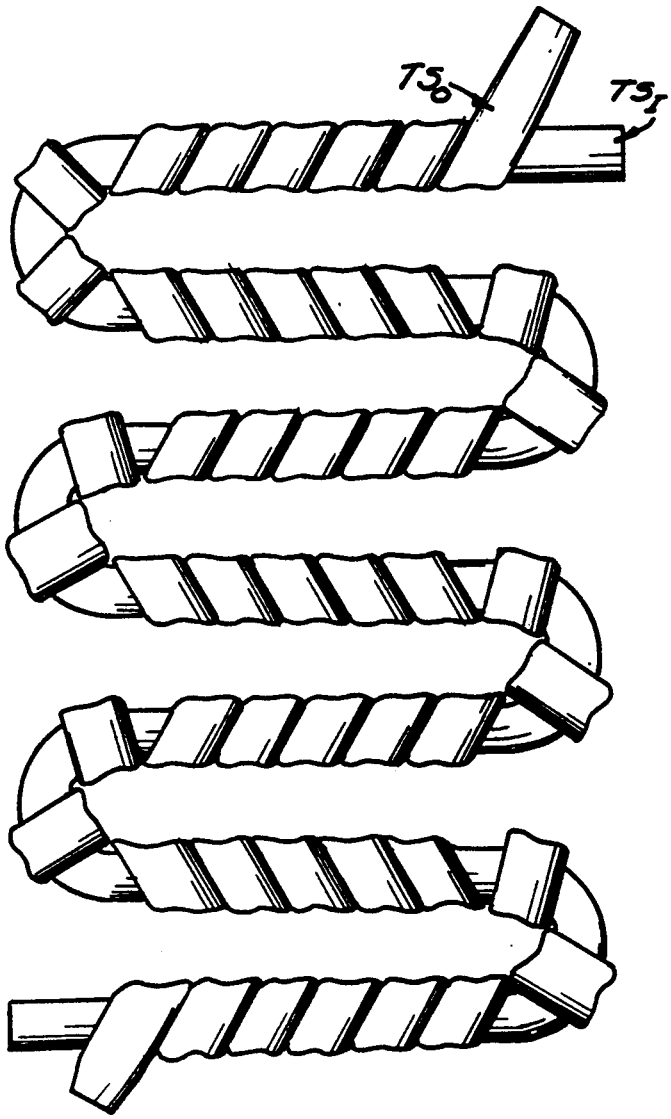
Figure 3:
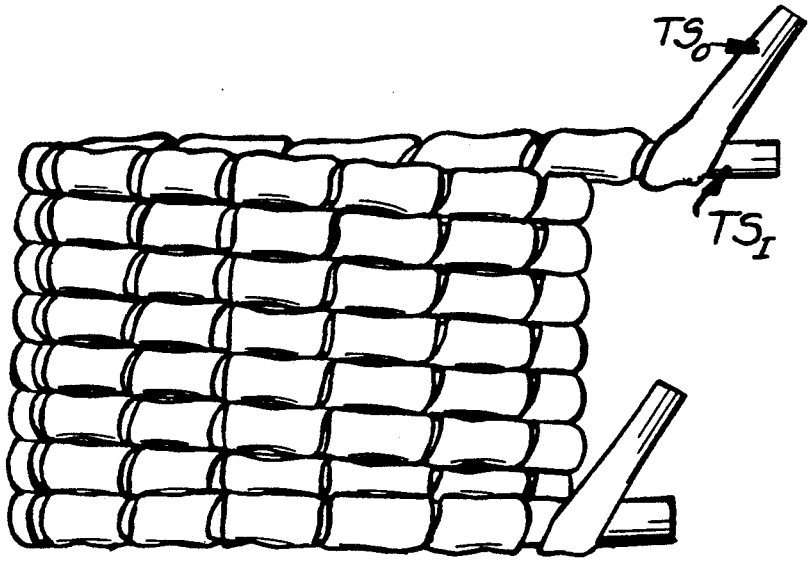
Figure 4:
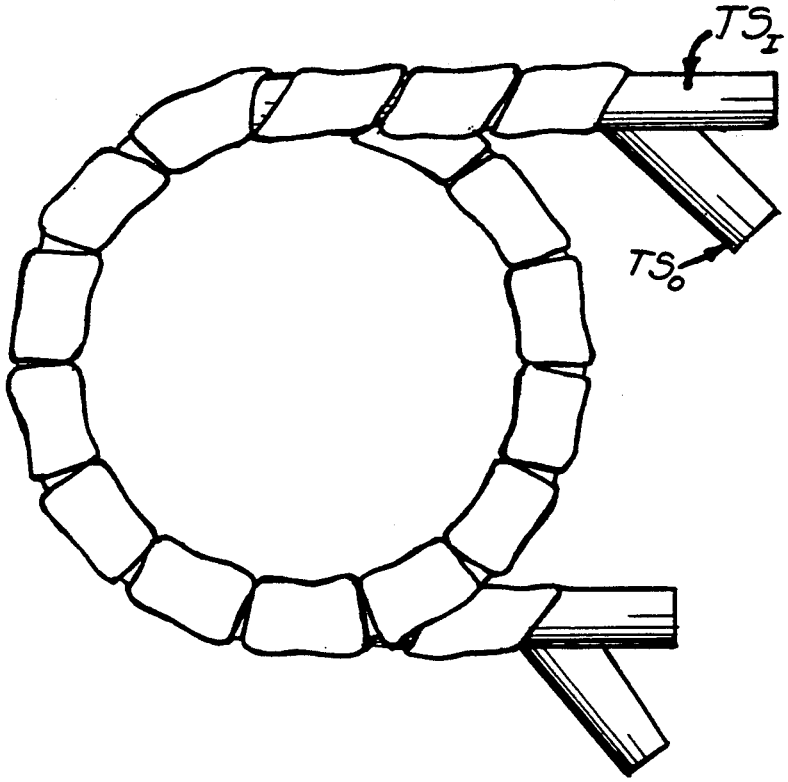

The winding process work hardens the outer coil 12 and assists in maintaining the circular cross-sectional shape of the inside tube for the next manufacturing step. In the next manufacturing step, the straight inside tube $TS_I$ for the inner coil 11 with the helically flighted outside tube $TS_O$ is formed into one of its desired final shapes as illustrated in FIGS. 3–7. FIGS. 3 and 4 show the inner coil formed into a helical shape while FIGS. 5 and 6 show the inner coil formed into a spiral shape and while FIG. 7 shows the inner coil formed into a serpentine shape. Almost any desired shape may be achieved. Various known bending techniques may be used for bending the tube $TS_I$. If the outer coil 12 is not sufficient to maintain the cross-sectional shape of the tube $TS_I$, the tube $TS_I$ may be internally pressurized to assist in preventing the collapse of the tube as it is bent. The cross-sectional size of the outer tube $TS_O$ is not significantly changed during this forming step.

Because the outer tube $TS_O$ work hardens during the winding step, it is very difficult to expand when pressure is applied. To overcome this problem, the partially formed coil assembly is next annealed in an inert atmosphere to reduce the temper of the copper to its fully annealed condition commonly called dead soft.

To finally form the outer coil 12, a high pressure gas or liquid is then applied to one end of at least the outer tube $TS_O$ while the other end is sealed off. The amount of pressure required depends on the wall thickness of the outer tube. For example, if the outside refrigerant tube has a wall thickness of 0.013 inch, the pressure required is typically about 1,300 psi. If the tube wall thickness of the inner tube $TS_I$ is sufficient, the inner tube need not be internally pressurized to prevent this tube from collapsing as the outside tube $TS_O$ expands. A thinner walled tube $TS_I$ will require internal pressurization to prevent this tube from collapsing as the outside tube expands. A typical internal pressure on the inside water tube $TS_I$ with a 0.016 in. wall is about 1,000 psi.

Figure 8:
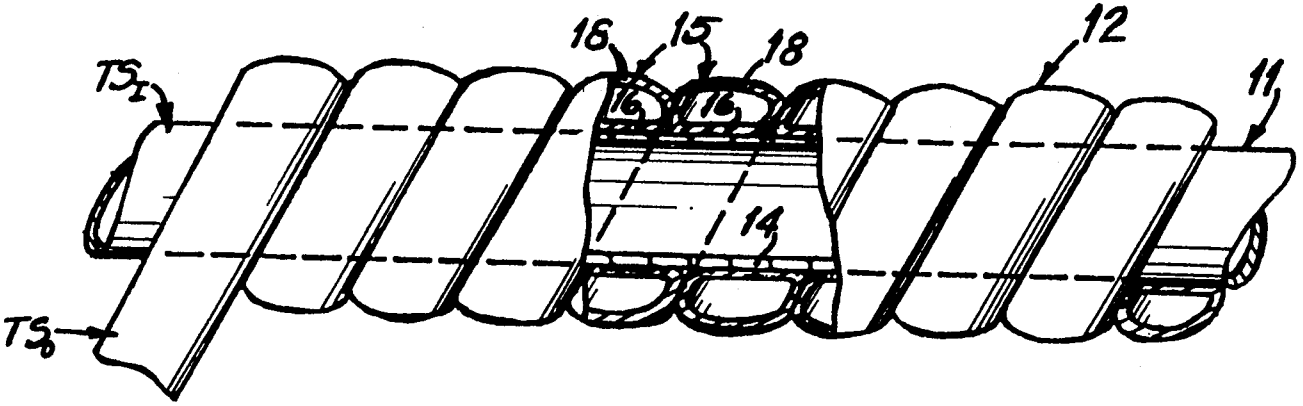
FIG. 8 is a side view of a short section of a heat transfer coil assembly shown partly in cross-section and showing the final stage in the manufacture thereof utilizing the invention.

FIG. 8 shows some of the coil segments of the outer tube $TS_O$ in cross-section after it has been expanded. The expansion increases the area of the thermal contact between the inner and outer tubes forming the water and the refrigerant circuits by reducing voids and provides a tight-contact between the two. The heat exchanger efficiency and pressure drop may be optimized by varying the cross-sectional area of the tubes within different expansion pressures. This is done practically by trial and error, although analytical estimates can be made.

The efficiency of the heat exchanger may be further increased by using internally ribbed or rifled tubing. This improves the heat transfer coefficient between the water, refrigerant, and tube walls by increasing the surface area of contact. A turbulator has been used, but is less effective.

When more than one outer tube $TS_O$ is used, the tubes are wrapped around the inner tube $TS_I$ in a side-by-side configuration. After final sizing of the outer tubes, each set of ends of the outer tubes are connected by a common manifold so that the tubes operate in parallel.

What is claimed as invention is:

1. A heat transfer coil for use with heat transfer fluids between which heat is to be transferred comprising:

a first elongate piece of heat conductive tubing defining a peripheral surface thereon and formed into a coil configuration; and a second piece of heat conductive tubing wound around said first piece of heat conductive tubing in a helical configuration with respect to said first piece of tubing and defining a plurality of helical flights having an inboard portion thereon, said helical flights arranged so that said inboard portion of said helical flights is in conforming intimate physical contact with said peripheral surface on said first elongate piece of heat conductive tubing, said second piece of tubing having been wound around said first piece of tubing while said first piece of tubing is substantially straight and then said first piece of tubing with said second piece of tubing therearound formed into said coil configuration, said first and second pieces of tubing defining fluid passages therethrough, the cross-sectional area of said passage through second piece of tubing having been adjusted by internally pressurizing said second piece of tubing to nonelastically deform said second piece of tubing to change the cross-sectional area of said passage through said second piece of tubing to a desired final size after said first and second pieces of tubing simultaneously annealed while maintaining substantially the same cross-sectional area of said passage through said first piece of tubing and while maintaining intimate physical contact between said first and second pieces of tubing.

2. The heat transfer coil of claim 1 wherein said coil configuration into which said first piece of tubing is formed is a helical shape.

3. The heat transfer coil of claim 1 wherein said coil configuration into which said first piece of tubing is formed is a serpentine shape.

4. The heat transfer coil of claim 1 wherein said coil configuration into which said first piece of tubing is formed is a spiral.

5. The heat transfer coil of claim 1 further including a plurality of said second pieces of tubing having been wound in parallel helical flights around said first piece of tubing before said first piece of tubing is formed into said coil configuration; and manifold means connecting opposite ends of said second pieces of tubing in parallel with each other.

6. A method of forming a heat transfer coil comprising steps of;

(a) winding a second piece of tubing helically around a first piece of tubing to form a coil in the second piece of tubing so that the second piece of tubing lies against the peripheral surface of said first piece of tubing where said second piece of tubing is deformed into a non-circular shape and the passage through said second piece of tubing has a deformed cross-sectional area smaller than the desired cross-sectional area the passage is to have when the heat transfer coil is completed;

(b) non-elastically forming the first of piece of tubing into an overall coil configuration independently of the configuration of the second piece of tubing;

(c) after non-elastically forming the first piece of tubing, internally pressurizing the second piece of tubing having the passage with the deformed cross-sectional area smaller than the desired cross-sectional area while the tubing is maintained in the helical configuration to non-elastically deform the second piece of tubing to change the cross-sectional area of the passage through the second piece of tubing to a desired final size while maintaining intimate physical contact between the pieces of tubing; and (d) simultaneously annealing the first and second pieces of tubing prior to step (c).

7. The method of claim 6 wherein the first piece of tubing is internally pressurized during step (c).

8. The method of claim 6 wherein the first piece of tubing is internally pressurized during step (b).

9. The method of claim 6 wherein step (d) further includes annealing both pieces of tubing to a dead soft condition.

10. The method of claim 9 wherein both pieces of tubing are copper.

* * * * *